US007150584B2

(12) United States Patent
Nishiyama et al.

(10) Patent No.: US 7,150,584 B2
(45) Date of Patent: Dec. 19, 2006

(54) STEEL-PIPE SHEET PILE AND COUPLING STRUCTURE OF STEEL-PIPE SHEET PILES

(75) Inventors: Yoshikazu Nishiyama, Fuchu (JP); Yoshiki Sono, Fujisawa (JP); Makoto Kimura, Kyoto (JP)

(73) Assignee: Data-Too Co., Ltd., Tokyo (JP)

( * ) Notice: Subject to any disclaimer, the term of this patent is extended or adjusted under 35 U.S.C. 154(b) by 61 days.

(21) Appl. No.: 10/844,088

(22) Filed: May 12, 2004

(65) Prior Publication Data

US 2005/0254905 A1 Nov. 17, 2005

(51) Int. Cl.
*E02D 5/14* (2006.01)
*E02D 5/02* (2006.01)
*E04H 17/16* (2006.01)

(52) U.S. Cl. ..... 405/274; 52/220.3; 256/73; 403/295; 403/298

(58) Field of Classification Search ..... 405/274, 405/276–278; 52/220.2, 220.3; 256/73; 403/292, 295, 298, 169, 178
See application file for complete search history.

(56) References Cited

U.S. PATENT DOCUMENTS 863,886 A * 8/1907 Skinner ..... 405/276
2,101,285 A * 12/1937 Stevens ..... 405/278
2,128,428 A * 8/1938 Murray, Jr. ..... 405/278
3,059,436 A * 10/1962 Hermann, Jr. ..... 405/278
3,411,305 A * 11/1968 Cella ..... 405/280
3,999,392 A * 12/1976 Fukushima et al. ..... 405/281
4,632,602 A * 12/1986 Hovnanian ..... 405/129.8
5,106,233 A * 4/1992 Breaux ..... 405/129.8
5,240,348 A * 8/1993 Breaux ..... 405/129.8
5,388,931 A * 2/1995 Carlson ..... 405/274
5,447,393 A * 9/1995 Yeates et al. ..... 405/276
5,800,096 A * 9/1998 Barrow ..... 405/267
6,732,483 B1 * 5/2004 White ..... 52/592.1

* cited by examiner

*Primary Examiner*—David Bagnell
*Assistant Examiner*—Tara L. Mayo
(74) *Attorney, Agent, or Firm*—Koda & Androlia

(57) ABSTRACT

A steel-pipe sheet pile including a steel pipe and joints for coupling the steel pipe to another steel pipe and multiple steel pipes arranged in a building direction of a steel-pipe sheet pile wall, wherein the joints include a male joint and a female joint each made of an H-shaped steel-beam coupled at flange edges to the steel pipe, and wherein the male joint is slightly smaller in size relative to the female joint so that the male joint can be fitted in a space defined by flange inside surfaces and web surface of a female joint of a neighboring steel-pipe sheet pile. The steel-pipe sheet pile is a joined-steel-pipe sheet pile including multiple steel pipes integrally coupled to one another via H-shaped steel-beams as tying members of H-shaped transverse cross-section.

8 Claims, 17 Drawing Sheets

STEEL-PIPE SHEET PILE AND COUPLING STRUCTURE OF STEEL-PIPE SHEET PILES

BACKGROUND OF THE INVENTION

1. Field of the Invention

The present invention relates to a steel-pipe sheet pile to be exemplarily employed in building a bridge foundation, and to a coupling structure of steel-pipe sheet piles.

2. Description of Related Art

It is presently essential to adopt a steel-pipe sheet pile foundation as one of bridge foundations. Upon building a foundation structure such as a pier within water, there are constructed cofferdam works based on steel-pipe sheet piles for coffering a targeted structure inside the cofferdam works.

As shown in FIG. 16 through 18, each of steel-pipe sheet piles 1 to be used for cofferdam works comprises a steel pipe 2 having right and left sides formed with joints 3, respectively, and the sheet piles are sequentially coupled to one another by connecting the pertinent joints 3 to the associated ones, respectively. Note that the mated joints 3 include various shape combinations such as: box shape and "T" shape; mutual "C" shapes; and "C" shape and "T" shape; and the illustrated ones are exemplary.

The steel-pipe sheet piles 1 are occasionally hammered by a hammering set machine (pile driver) based on a diesel pile hammer, which is accompanied by strong noise vibrations due to hammering operation, thereby leading to constructional pollution. Thus, there is also adopted a method for pressing sheet piles into the earth such as by a hydraulic jack or vibratory hammer while reducing an intrusive resistance by earth auger excavation, such that the steel pipes 2 are set-one by one as single elements in case of each of the hydraulic jack and vibratory hammer.

When the cofferdam works are constructed such as by inserting or hammering and placing the steel pipes 2 one by one into excavated holes in the above manner, there are required considerable time and effort and the joints 3 tend to be bent due to increased inserting resistances upon constructing the cofferdam works, thereby making it difficult to ensure the vertical precision of the steel-pipe sheet piles 1 themselves.

Although it is possible to simultaneously establish a plurality of excavated holes by employing a multi-auger machine as the earth auger in case of setting the steel-pipe sheet piles 1 into excavated holes provided by the preceded earth auger excavation in the above manner, the man-hours are not reduced because the steel-pipe sheet piles 1 are arranged principally one by one in the above manner.

Further, it is assumed to be technically difficult to perform the above construction method, about water depths exceeding 10 meters in case of a soft ground and about water depths exceeding 15 meters in case of a hard ground. Particularly, there has been issued such an administrative notification that the construction method based on a single steel-pipe sheet pile should not be adopted in deep water, in view of the defect due to the insufficient water-stopping ability of the construction method.

Meanwhile, the portions of joints 3 are exerted with shearing forces in the up-and-down direction, when the steel-pipe sheet pile foundation is exerted with external forces in a horizontal direction. Shearing forces stronger than shearing yield strengths of the joints rapidly increase shearing deformations of the joint portions, thereby also considerably deteriorating the bending rigidity of the whole of the steel-pipe sheet pile foundation.

To overcome such disadvantages, there has been provided a steel-pipe sheet pile, which is capable of achieving a larger strength of the whole of the steel-pipe sheet pile than the conventional, such that multiple steel pipes can be simultaneously hammered and placed to thereby remarkably shorten the constructing term, and multiple steel pipes are previously coupled to one another with a predetermined precision to thereby attain a higher constructing precision and an improved vertical precision (see Japanese Patent Application No. 2001-7198112 (JP-A-2003-13441)).

The technique noted just above is to hammer and place combined bodies of previously and integrally coupled multiple steel-pipe sheet piles as shown in FIG. 19, in which two juxtaposed steel pipes 2, 2 are integrally coupled to each other by an H-shaped steel-beam 4 acting as a tying member of an H-shaped transverse cross-section and having flange edges coupled to the peripheral surfaces of the associated steel pipes 2, respectively, while providing joints 3 at sides of the steel pipes opposite to the mutually coupled sides, respectively.

This H-shaped steel-beam 4 may be an extrusion molded one, or independently and appropriately assembled by welding such as in a factory. In case of employing the shaped steel-beams, right and left edges of flanges 4*a* are to be welded to the peripheral surfaces of the steel pipes, thereby defining a tightly closed space 5 enclosed in all directions by these parallel flanges 4*a* and steel pipes 2, 2. In this figure, reference numeral 4*b* designates a web.

The steel-pipe sheet pile 1 is established into a double-pipe type, based on the joints 3 provided at sides of the steel pipes 2, 2 opposite to the mutually coupled sides by the H-shaped steel-beam 4, respectively. The joints 3 are similar to those conventional ones shown in FIGS. 16 through 18, and these exemplary configurations are the same as those of FIG. 17, i.e., each steel pipe 2 is weldedly mounted at its peripheral surface with a tube body of a C-shaped transverse cross-section, which is an annular body having a slit 3*a*. Although the joint 3 itself is provided on the steel pipe 2 strictly in the transverse direction of the associated steel pipes 2, the slit 3*a* is opened not in such a transverse direction but in an oblique direction, so that slits 3*a* are opened in symmetrical directions when the joints 3 are opposed to each other, resulting in that the joints 3 are engaged with each other in a manner that the joints 3 enter each other through slits 3*a*, respectively.

Note that the joints 3 are not limited to the shown examples, and it is possible to adopt as another example such simple shapes that one of the paired joints is a single male member to be inserted into a spacing defined by two pieces of the other female member.

Each steel pipe 2 is mounted with a tube body 17 having a slit 17*a* such as by welding at the peripheral surface of the steel pipe near the associated joint 3, so as to protrudingly provide an engagement groove 6 outside the steel pipe 2. The slits 17*a* of these tube bodies 17 are opened in oblique directions, respectively, such that those lines drawn from these openings are interconnected with each other to define an arc when the joint 3 of one sheet pile is engaged with that of another sheet pile. Note that each tube body 17 has a diameter smaller than that of the joint 3.

In this figure, reference numeral 18 designates a flexible plate such as made of steel plate having flexibility and having opposite ends provided with pipes 19 as anchoring members, respectively, such that these pipes 19 are allowed to be inserted into the tube bodies 17 constituting the engagement grooves 6, respectively.

According to this Japanese Patent Application No. 2001-7198112, each steel-pipe sheet pile defines a tightly closed space enclosed in all directions by the shaped steel-beam and the steel pipes. Namely, the steel-pipe sheet pile is in the shape including the steel pipes and the H-shaped steel-beam welded at four ends to the steel pipes in a manner to establish an integrated jointed-steel-pipe sheet pile comprising multiple steel pipes joined to each other by H-shaped steel-beams, thereby enabling a correspondingly increased strength and allowing support of loads not only in the minor axis direction but also in the major axis direction.

This simply reduces the number of couplings between the joints down to a half or less, of the number of conventionally constructed joints, and also reduces the number of water stopping works (such as mortar impregnation or chemical grouting), thereby achieving a (environment protecting) construction which has an improved economical effect and which is friendly to the environment based on the reduced contamination of water quality by virtue of the reduced-impregnation amount. Further, varying the shapes of the coupling H-shaped steel-beams enables construction of shaped portions having every possible curvature.

Simultaneously hammering and placing two steel pipes is more advantageous than hammering and placing one by one and enables a remarkably shortened constructing term, so that the remarkably shortened term of pontoon usage such as seen in a marine construction exhibits an economically greater advantage as even compared with a land-based construction. Further, two steel pipes are joined to each other at a predetermined precision, thereby providing a higher constructing precision and improving a vertical precision.

Moreover, the configurations joined by the H-shaped steel-beam members can be effectively utilized in a manner to reduce the time and laborious efforts for exemplarily boring holes in conventional steel pipes such as in construction and installation of back anchoring tie-rods, thereby achieving an economical advantage.

Coupling by the H-shaped steel-beams enables the surface of each of the hammered and placed steel pipes in the minor axis direction to be readily reinforced and coupled, thereby allowing utilization and development in "inhibiting pile", "landing pier" and "temporary bridge" by utilizing such characteristics that the coupled steel pipes provide not only a bending rigidity in the minor axis direction but also a higher bending rigidity in the major axis direction.

Moreover, the exterior portions of the joints are enclosed by the flexible plate to thereby attain water stopping at these portions, such that the flexible plate can be installed in an extremely simple manner to insert the anchoring members at the ends of the flexible plate into the engagement grooves, respectively. Note that the flexibility of the flexible plate allows it to be curved and bulged, thereby facilitating dimensional adjustment.

While the steel-pipe sheet pile described in the Japanese Patent Application No. 2001-7198112 exhibits the shape where one steel pipe is welded to the other steel pipe at four ends of the H-shaped steel-beam in a manner to already ensure a sufficient rigid ability by virtue of the jointed-steel-pipe sheet pile comprising multiple steel pipes joined to each other by the H-shaped steel-beam so that a further rigid ability appears to be unnecessary, the rigidity should not be considered for the coupling between the joints of such conventional jointed-steel-pipe sheet piles themselves each having joints at opposite ends, from a designing standpoint.

Then, the portions of the joints 3 are exerted with shearing forces in the up-and-down direction when the foundation formed of the steel-pipe sheet piles is exerted with external forces in a horizontal direction. Shearing forces stronger than shearing yield strengths of the joints rapidly increase shearing deformations of the joint portions, thereby also considerably deteriorating the bending rigidity of the whole of the steel-pipe sheet pile foundation.

Methods for improving the shearing yield strength of the joint itself include: a method for providing many projections at an inner surface of a circular steel pipe constituting the joint member to thereby improve the shearing yield strength of the joint by enhancing a bonding strength between the circular steel-pipe and the mortar by virtue of the effect of the projections; a method for increasing the diameter of a circular steel pipe constituting a joint member to thereby improve the shearing yield strength of the joint by increasing a bonding area between the circular steel pipe and mortar by virtue of the increased diameter; and a method as shown in JP-A-2000-220135, which provides bumps on an inner surface of a circular steel pipe as a joint, and which provides a reinforcing member for coupling an outer surface of a main pipe to an outer surface of a circular steel pipe at a longer arc of two arcs of the circular steel pipe, the two arcs circumferentially extending: from a mounting portion of the circular steel pipe to the main pipe of the steel-pipe sheet pile; to a position of a slit of the circular steel pipe.

However, the strength of the joints have not been sufficient, even by such techniques.

Moreover, in case of continuously hammering and placing the conventional jointed-steel-pipe sheet piles each having joints at opposite ends, respectively, the jointed-steel-pipe sheet piles themselves are joined to each other by the conventional joints (such as P—P joint). Thus, although the perfect water stopping can be achieved for each jointed-steel-pipe sheet pile in itself, there remains a risk of water leakage at the location between the conventional types of joints of the jointed-steel-pipe sheet piles. Therefore, it is an essential theme to improve the water-shielding ability at the locations of joints at opposite ends of jointed-steel-pipe sheet piles, in case of utilizing such sheet piles as a revetment for a waste landfill.

It is therefore an object of the present invention to provide a steel-pipe sheet pile and a coupling structure of steel-pipe sheet piles, capable of overcoming the disadvantages of the aforementioned conventional examples and capable of improving both of rigid ability and water-stopping ability at a gap between joints not only in steel-pipe sheet piles each comprising a single steel pipe provided at opposite peripheral sides thereof with joints, respectively, but also in a double-pipe type of steel-pipe sheet pile.

SUMMARY OF THE INVENTION

To achieve the above object, an essential point of the invention is to provide a steel-pipe sheet pile including a steel pipe and joints for coupling the steel pipe to another steel pipe in multiple steel pipes arranged in a building direction of a steel-pipe sheet pile wall, wherein the joints include a male joint and a female joint each made of an H-shaped steel-beam coupled at flange edges to a peripheral surface of the steel pipe, and wherein the male joint is slightly small-sized relative to the male joint so that the male joint can be fitted in a space defined by flange inside surfaces and web surface of a female joint of a neighboring steel-pipe sheet pile.

According to the invention, the joint is joinedly established to have an H-shaped transverse cross-section to thereby increase its strength by virtue of the presence of the web, thereby allowing support of loads not only in the minor axis direction but also in the major axis direction. Namely, since the shearing force acts substantially in the pipe axis direction, the provision of reinforcing members comprising the webs along the pipe axis direction effectively reinforces the pipe.

Further, the joints can be fitted to each other by merely overlapping the flange edges thereof with each other, so that the flange tip ends of one joint are brought closer to and nearly abut on the web of the other joint to thereby allow obtainment of a tightly and robustly closed space, while ensuring the water-stopping ability.

Particularly concerning the water stopping, the joints (H—H shape steel joint) based on the H-shaped steel-beams of different sizes are expected to further enhance the water-shielding ability of the jointed-steel-pipe sheet piles as a revetment for a waste landfill. The H—H shape steel joints at both ends of the jointed-steel-pipe sheet pile are previously adhered with water swelling sheets, thereby enabling shield of water without applying mortar filling (water shielding treatment in a conventional joint). Concerning the water shielding treatment based on mortar filling for the conventional joint, problems have been pointed out such as about achievement of water-shielding ability and contamination risk in surrounding sea areas.

Thus, the water-shielding ability and environmental suitability of the jointed-steel-pipe sheet piles as the revetment for a waste landfill can be further enhanced by improving the joint portions at opposite ends of the jointed-steel-pipe sheet piles by virtue of the H—H shape steel joints, respectively.

Moreover, those portions enclosed by the mutual fitting of the joints are filled with a filling material such as concrete, thereby enabling the outside portions of the joints to be coated by the filling material such as concrete to thereby improve the water stopping effect, while the filling material such as concrete can be readily filled by a tremie pipe.

An essential point of the invention is that the inside surfaces of the flanges of the female joint and the outside surfaces of the flanges of the male joint are provided with projections, respectively.

According to the invention the projections are provided between the overlapped flanges so that the clearance between the flanges is cooperatively sealed by the projections, thereby enabling further enhancement of water stopping between the flanges.

An essential point of the invention is that the steel-pipe sheet pile is a jointed-steel-pipe sheet pile including multiple steel pipes integrally coupled to one another via tying members of H-shaped transverse cross-sections, respectively, such that each tying member has flange edges coupled to peripheral surfaces of the associated steel pipes to be plurally arranged in a building direction of a steel-pipe sheet pile wall.

According to the invention there is defined a tightly closed space enclosed in all directions by the flanges and steel pipes in the steel-pipe sheet pile. Namely, the jointed-steel-pipe sheet pile is in a shape including steel pipes welded to each other at four ends of the H-shaped steel-beam to thereby establish the integrated jointed-steel-pipe sheet pile comprising multiple steel pipes joined to each other by the H-shaped steel-beams, thereby allowing a correspondingly increased strength and allowing support of loads not only in the minor axis direction but also in the major axis direction. Although the rigidity for the coupling between the joints of the conventional steel-pipe sheet piles having joints at opposite ends of the sheet piles is not considered from a designing standpoint, multiple steel pipes are joined to one another by the H-shaped steel-beams in the present invention and the rigidity is sufficiently considered to thereby increase a moment of inertia of area in the minor axis direction.

This simply reduces the number of couplings between the joints down to a half or less, of the number of conventionally constructed joints, and also reduces the number of water stopping works (such as mortar impregnation or chemical grouting), thereby achieving an improved economical effect. Further, varying the shapes of the coupling H-shaped steel-beams enables construction of shaped portions having every possible curvature.

Simultaneously hammering and placing two steel pipes is more advantageous than hammering and placing one by one and enables a remarkably shortened constructing term, so that the remarkably shortened term of pontoon usage such as seen in a marine construction exhibits an economically greater advantage as even compared with a land-based construction. Further, multiple steel pipes are joined to one another at a predetermined precision, thereby providing a higher constructing precision and improving a vertical precision.

Furthermore, the configurations joined by the H-shaped steel-beam members can be effectively utilized in a manner to reduce the time and laborious efforts for exemplarily boring holes in conventional steel pipes such as in construction and installation of back anchoring tie-rods, thereby achieving an economical advantage. Coupling by the H-shaped steel-beams enables the surface of each of the hammered and placed steel pipes in the minor axis direction to be readily reinforced and coupled, thereby allowing utilization and development in "inhibiting pile", "landing pier" and "temporary bridge" by utilizing such characteristics that the coupled steel pipes provide not only a bending rigidity in the minor axis direction but also a higher bending rigidity in the major axis direction.

An essential point of the invention is that the steel-pipe sheet pile further-comprises: a coupling member having a T-shaped cross-section and outwardly protruded from the web of the male joint; and a cut-out defined at the web of the female joint so that the cut-out is inserted with a T-shaped coupling member of a neighboring steel-pipe sheet pile.

According to the invention the top portion of the T-shaped coupling member is inserted inside the web of the female joint in a state where the male joint and female joint are fitted to each other. This attains the fitting between the male joint and female joint which is not easily released to allow prevention of so-called pile opening. Also concerning an aspect of water stopping, even when water has infiltrated into the inside of the joints through the overlapping portion of flanges at one sides of the male joint and female joint, the infiltrating water passes from the flanges and the web, and then along the T-shaped coupling member to flow into the inside of the web of the female joint, and thereafter flows in the direction toward the flanges at the opposite side. This prolongs the flowing distance as compared with the conventional, thereby improving the water stopping operation.

An essential point of the invention is that the male joint is provided with projected segments projected from flange tip ends of the male joint, respectively, opposingly to each other and parallelly to the web of the male joint, in a manner to define a clearance between tip ends of the projected segments, and that the female joint is provided with outwardly protruded angle pieces projected from the web of the female joint so as to fit to the projected segments.

According to the invention in a state where the male joint and female joint are fitted to each other, not only the flanges of both joints are overlapped with each other, but also the projected segments, the tip end portions of the protruded angle pieces and the web of the female joint are triply overlapped with one another. This attains the fitting between the male joint and female joint which is not easily released to allow prevention of so-called pile opening. Further, even when water has infiltrated into the inside of the joints through the overlapping portion of flanges at one sides of the male joint and female joint, the infiltrating water does not reach the flanges at the other sides unless the infiltrating water travels from the flanges at one sides through multiple curves at the overlapping portions between the projected segments and protruded pieces, thereby prolonging the distance for water flow as compared with the conventional, to thereby improve the water stopping operation.

An essential point of the invention is to provide a coupling structure of steel-pipe sheet piles each including a steel pipe, a male joint and a female joint, wherein the male joint and the female joint are made of H-shaped steel-beams having flange edges coupled to a peripheral surface of the steel pipe, and wherein the male joint of one steel-pipe sheet pile is fitted in a space defined by flange inside surfaces and web surface of a female joint of a neighboring steel-pipe sheet pile in a manner to sequentially couple the steel-pipe sheet piles to one another to thereby constitute a steel-pipe sheet pile wall.

According to the invention there can be rationally fabricated a steel-pipe sheet pile wall by the coupling structure of steel-pipe sheet piles utilizing steel-pipe sheet piles or jointed-steel-pipe sheet piles.

An essential point of the invention is that the coupling structure further comprises swelling waterproof materials provided at inside surfaces of flanges of the female joint and outside surfaces of flanges of the male joint, respectively, of each steel-pipe sheet pile.

According to the invention the clearance between the flanges is sealed by the swelling waterproof materials, thereby enabling further enhancement of water stopping between the flanges. In this way, the H—H shape steel joints at both ends of the steel-pipe sheet pile are previously adhered with water swelling sheets, thereby enabling shield of water without applying mortar filling (water shielding treatment in a conventional joint). Concerning the water shielding treatment based on mortar filling, although problems have been pointed out such as about achievement of water-shielding ability and contamination risk in surrounding sea areas, it is possible by the present invention to further enhance the water-shielding ability of the steel-pipe sheet pile and the environmental suitability.

An essential point of the invention is that the coupling structure further comprises projections and swelling waterproof materials provided at inside surfaces of flanges of the female joint and outside surfaces of flanges of the male joint, respectively, of each steel-pipe sheet pile.

According to the invention the projections are provided between the overlapped flanges so that the clearance between the flanges is cooperatively sealed by the projections, thereby enabling further enhancement of water stopping between the flanges, while the clearance between the flanges is further sealed by the swelling waterproof materials thereby enabling further enhancement of the water stopping between the flanges.

An essential point of the invention is that each of the steel-pipe sheet piles further comprises: a coupling member having a T-shaped cross-section and outwardly protruded from the web of the male joint; and a cut-out defined at the web of the female joint so that the cut-out is inserted with a T-shaped coupling member of a neighboring steel-pipe sheet pile; and that the fitting between the male joint and the female joint defines water stopping spaces comprising: a first space enclosed by the web and flanges of the female joint and a peripheral surface of the steel pipe; and second and third spaces enclosed by the web of the female joint, flanges and webs of the male joint of a neighboring sheet pile and split by the T-shaped coupling member of the neighboring sheet pile.

According to the invention the flowing distance of the infiltrating water from the outside to the inside of the steel-pipe sheet pile is prolonged by the roundabout through the first through third spaces by virtue of the interposition of the coupling member, thereby improving the water stopping ability. The water stopping effect is further enhanced by filling the filling material into the first through third spaces.

The steel-pipe sheet pile and the coupling structure of steel-pipe sheet piles of the present invention as described above are capable of improving both of the rigid ability and water-stopping ability at a gap between joints not only in steel-pipe sheet piles each comprising a single steel pipe provided at opposite peripheral sides thereof with joints, respectively, but also in a double-pipe type of steel-pipe sheet pile. Further, the coupling member is interposed in the gap between joints to thereby prolong the length of the path through which the infiltrating water is to flow, thereby enabling improvement of the water-stopping ability.

DETAILED DESCRIPTION OF THE PREFERRED EMBODIMENTS

Embodiments of the present invention will be described hereinafter with reference to the drawings. Firstly explaining a steel-pipe sheet pile of the present invention, FIG. 1 is a plan view showing a first embodiment of one unit of steel-pipe sheet pile according to the present invention, and FIG. 2 is a plan view showing a first embodiment of one unit of double-pipe type of steel-pipe sheet pile according to the present invention.

Figure 1:
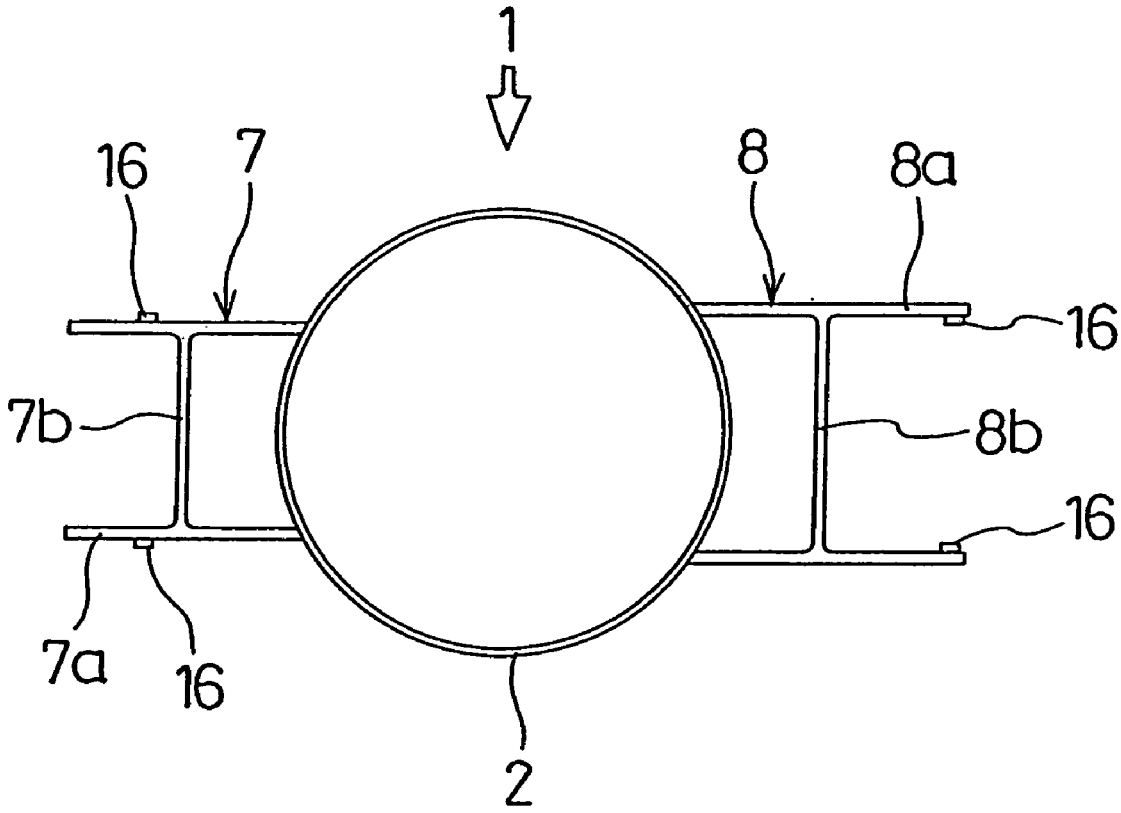
FIG. 1 is a plan view showing a first embodiment of one unit of steel-pipe sheet pile according to the present invention.

In case of a single steel pipe 2 as shown in FIG. 1, the steel pipe is provided with a male joint 7 made of an H-shaped steel-beam and a female joint 8 made of another H-shaped steel-beam provided at one and the other peripheral sides of the steel pipe, respectively.

Figure 2:
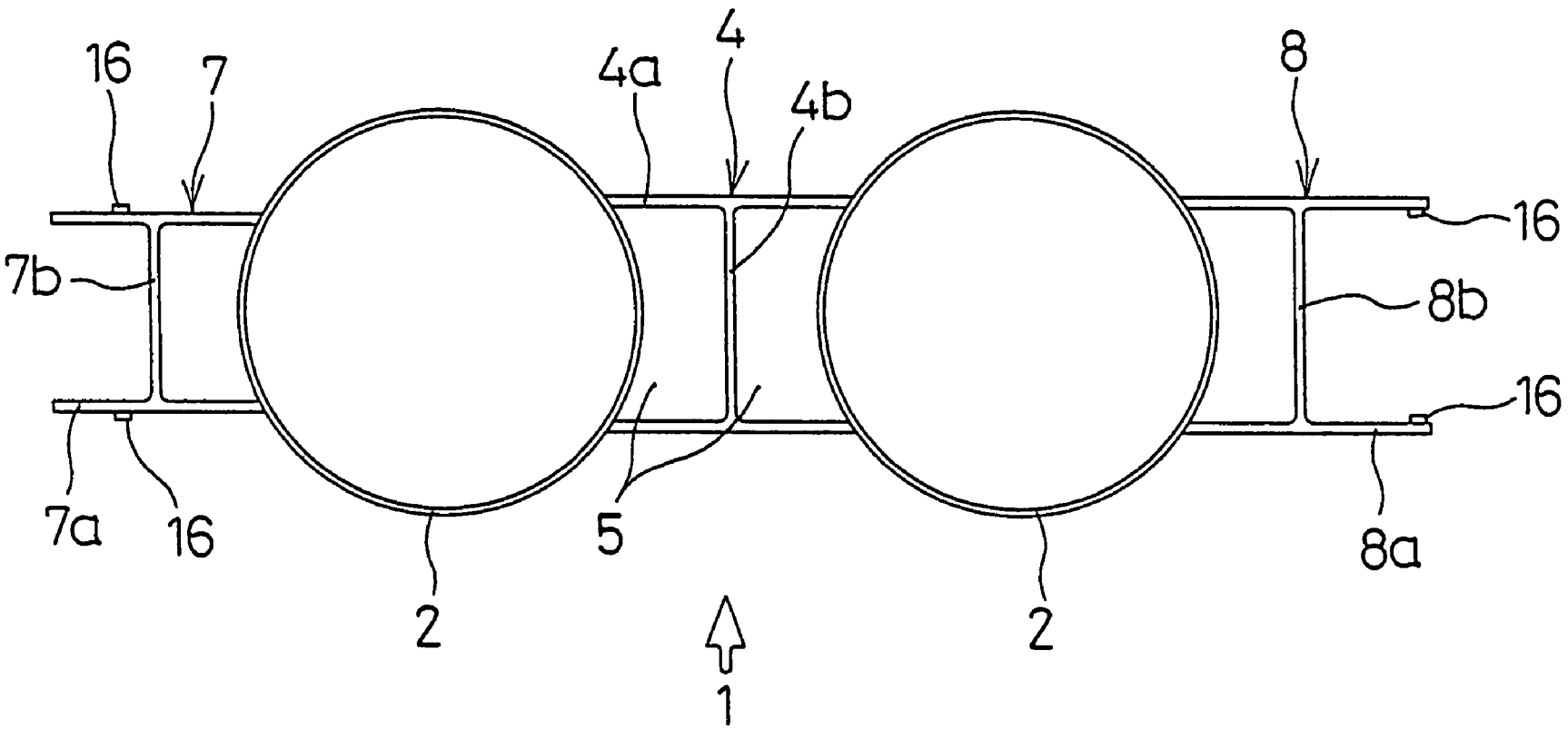
FIG. 2 is a plan view showing a first embodiment of one unit of double-pipe type of steel-pipe sheet pile according to the present invention.

Further, in case of a double-pipe type of steel-pipe sheet pile 1 including two steel pipes 2 as shown in FIG. 2, the steel-pipe sheet pile 1 is provided with: an H-shaped steel-beam 4 as a tying member having flange edges coupled to the peripheral surfaces of the juxtaposed steel pipes 2, respectively, to thereby integrally interconnect the steel pipes 2 with each other while leaving a spacing between the steel pipes correspondingly to the width of the H-shaped steel-beam 4; and a male joint 7 made of an H-shaped steel-beam and a female joint 8 made of another H-shaped steel-beam, at locations opposite to the interconnection, respectively.

This H-shaped steel-beam 4 may be a rolled one, or independently and appropriately assembled by welding such as in a factory. In case of employing the rolled steel-beams, right and left edges of flanges 4*a* are to be welded to the peripheral surfaces of the steel pipes, thereby defining a tightly closed space 5 enclosed in all directions by these parallel flanges 4*a* and steel pipes 2, 2. In this figure, reference numeral 4*b* designates a web.

Identically to the tying member between the steel pipes 2, the male joint 7 and female joint 8 have basic structures of H-shaped transverse cross-sections comprising combinations of flanges 7*a*, 8*a* and webs 7*b*, 8*b*, respectively, such that the edges of the flanges 7*a*, 8*a* are coupled to the peripheral surfaces of the associated steel pipes 2, respectively. The male joint 7 is to be slightly small-sized relative to the female joint 8.

Figure 3:
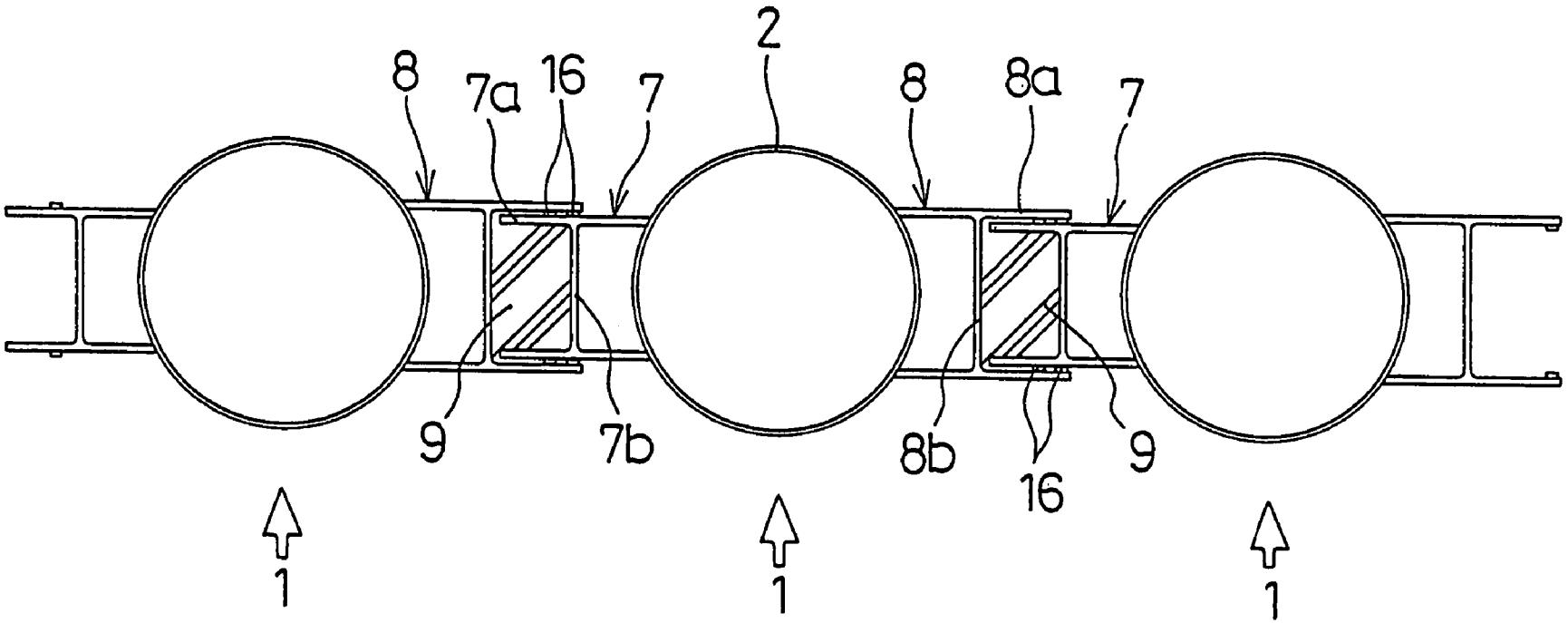
FIG. 3 is a plan view showing a coupling structure of steel-pipe sheet piles of FIG. 1.
Figure 4:
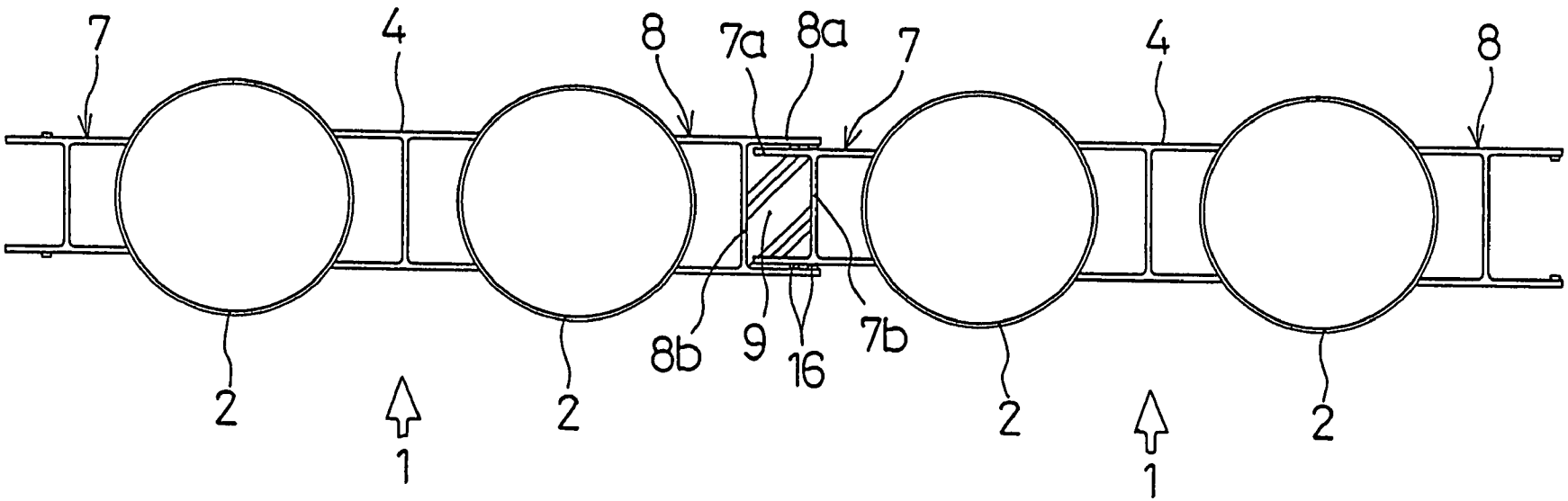
FIG. 4 is a plan view showing a coupling structure of steel-pipe sheet piles of FIG. 2.
Figure 5:
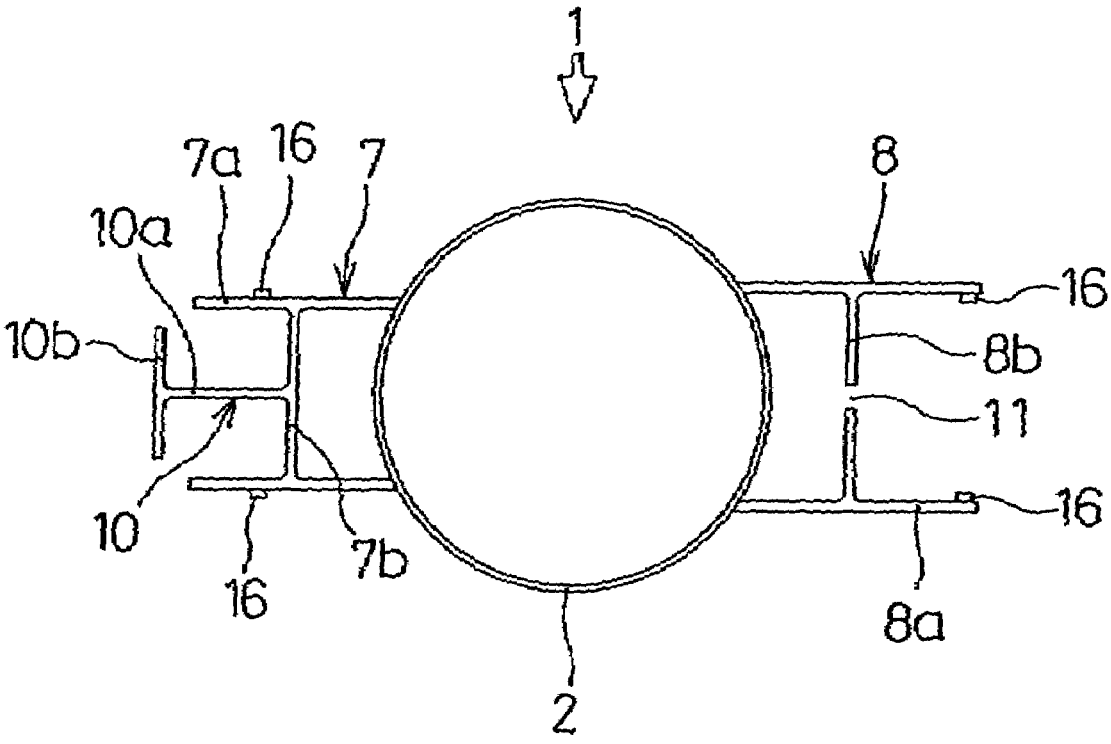
FIG. 5 is a plan view showing a second embodiment of one unit of steel-pipe sheet pile according to the present invention.
Figure 6:
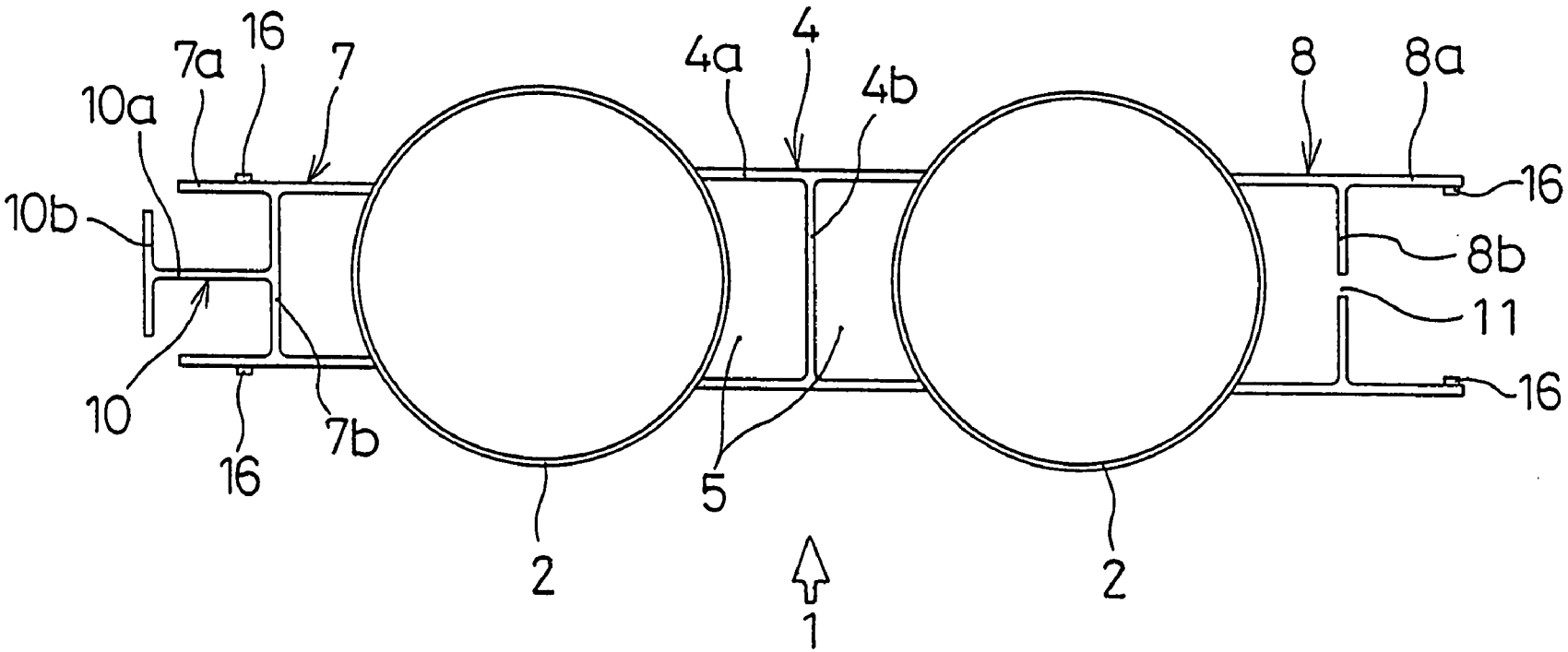
FIG. 6 is a plan view showing a second embodiment of one unit of double-pipe type of steel-pipe sheet pile according to the present invention.
Figure 7:
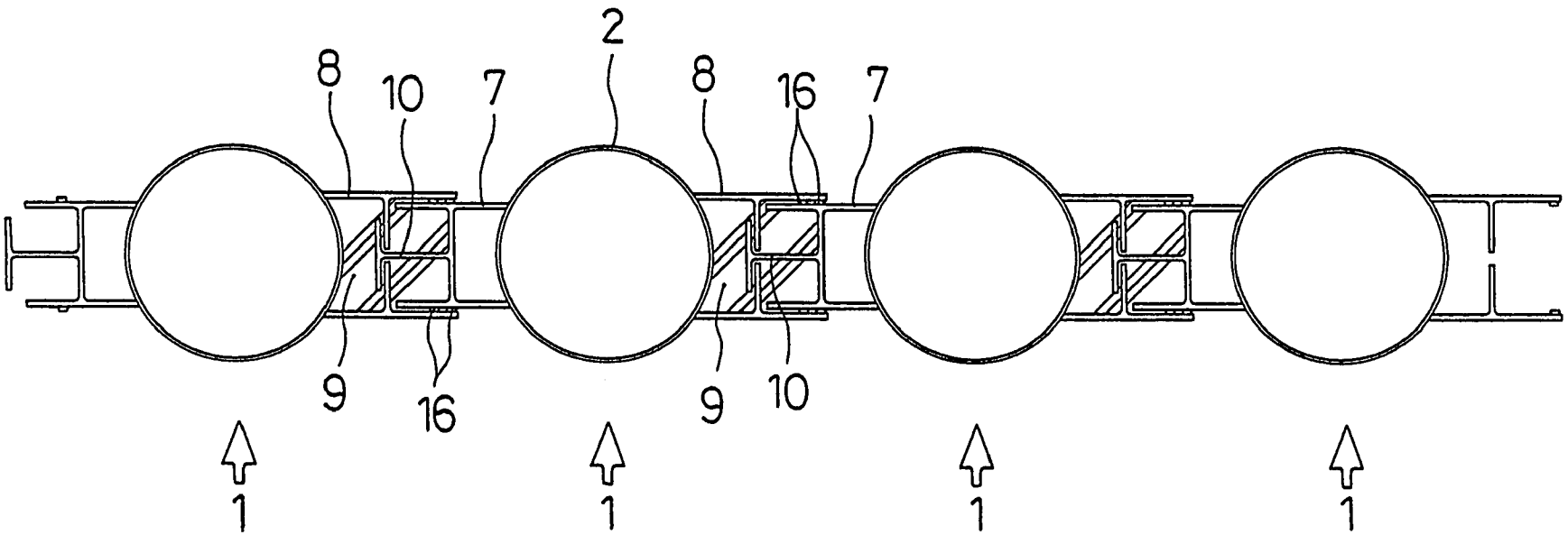
FIG. 7 is a plan view showing a coupling structure of steel-pipe sheet piles of FIG. 5.
Figure 8:
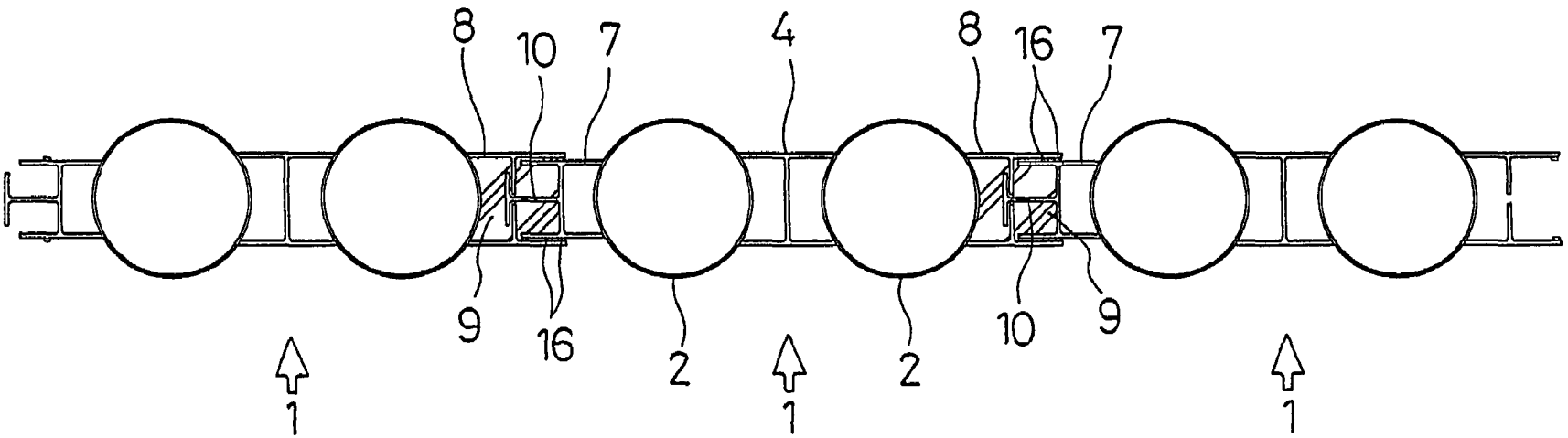
FIG. 8 is a plan view showing a coupling structure of steel-pipe sheet piles of FIG. 6.
Figure 9:
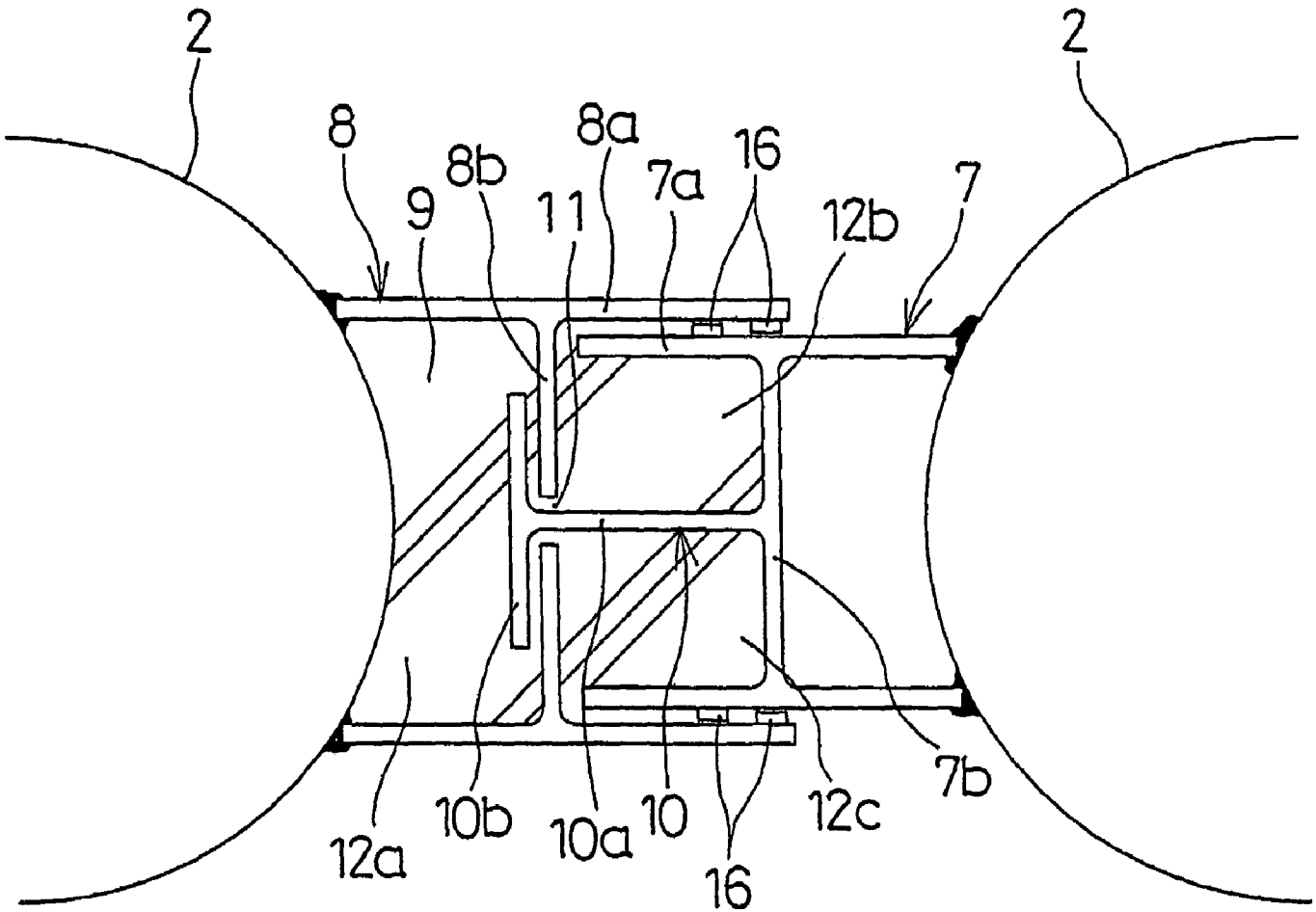
FIG. 9 is a plan view of essential parts of a second embodiment of a coupling structure of steel-pipe sheet piles according to the present invention.

In case of continuously hammering and placing pertinent ones of such steel-pipe sheet piles 1, the fitting between each male joint 7 and the associated female joint 8 is established such that the flanges 7*a* of the male joint 7 are brought to be interposed between the flanges 8*a* of the female joint 8 and the tip ends of the flanges 7*a* are brought closer to the flange 8*a* of the female joint 8, thereby allowing formation of a tightly closed space enclosed by the flanges 7*a*, 8*a* and webs 7*b*, 8*b* as shown in FIGS. 3, 4 so that the space is filled with a filling material 9 such as concrete or mortar by using a tremie pipe. Although not shown, it is also possible to provide reinforcing steels within the tightly closed space as required.

Note that the male joint 7 and female joint 8 are provided with projections 16 in the shapes of longitudinal ribs at inside surfaces of the flanges 8*a* of the female joint 8 and at outside surfaces of the flanges 7*a* of the male joint 7, respectively, while providing swelling waterproof materials 20. Usable as the projections 16 in the shapes of longitudinal ribs are round rods or flat bars.

The swelling waterproof material 20 is a waterproof material sheet having flowability and comprising a synthetic resin elastomer as a base component blended with a polymer having a higher water absorptivity, a filling material, a solvent and the like. Further, the water extracted from a dry coating of the sheet satisfies the water quality criteria based on the Japanese Food Sanitation Law, and is suitable for the environment. The water swelling sheet adopted in this test starts to be swollen in 1 to 2 hours after immersed in water, and is swollen to a size of about 20 times as large as the original after 20 hours. It is desirable for the water swelling sheet after swelling to exhibit a water permeability coefficient of $1.42\times10^{-9}$ cm/s.

There will be explained hereinafter a water permeability test for the male joint 7 and female joint 8 (H—H shape steel joint) applied with such swelling waterproof materials 20.

Figure 14:
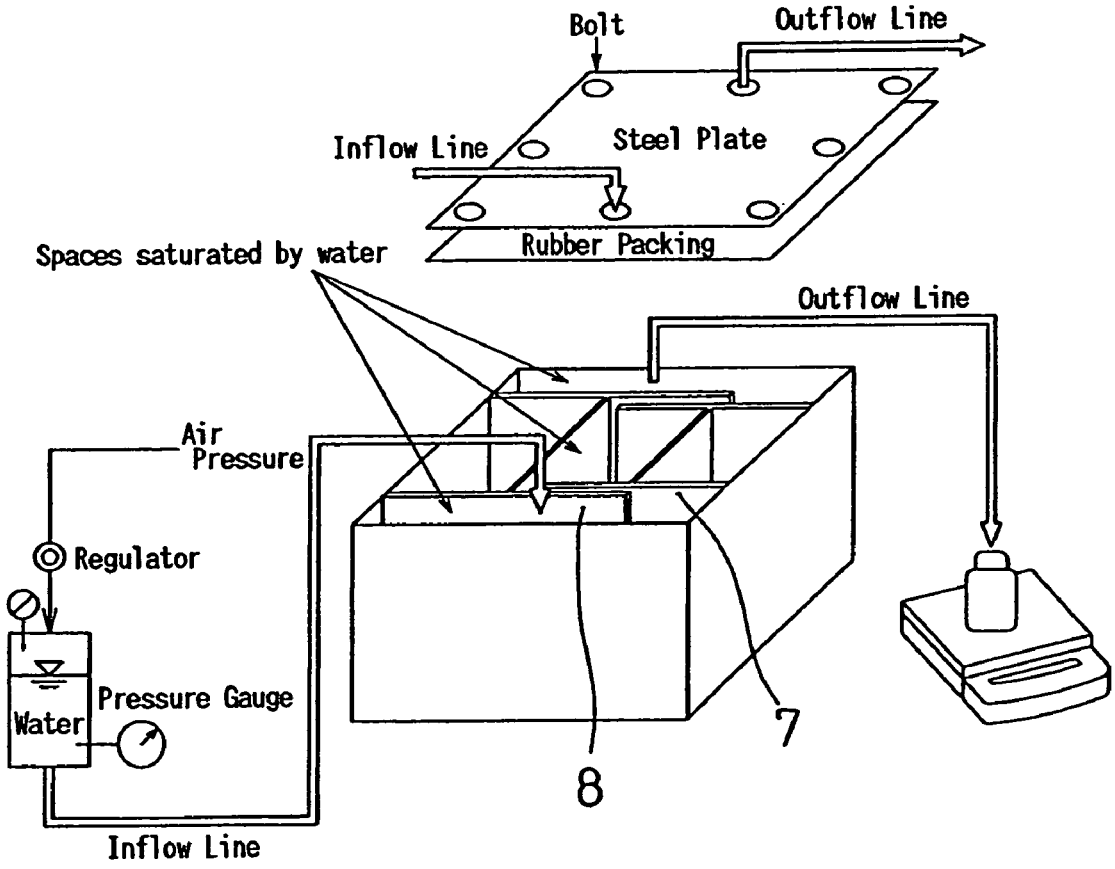
FIG. 14 is a perspective view of a testing apparatus.
Figure 15:
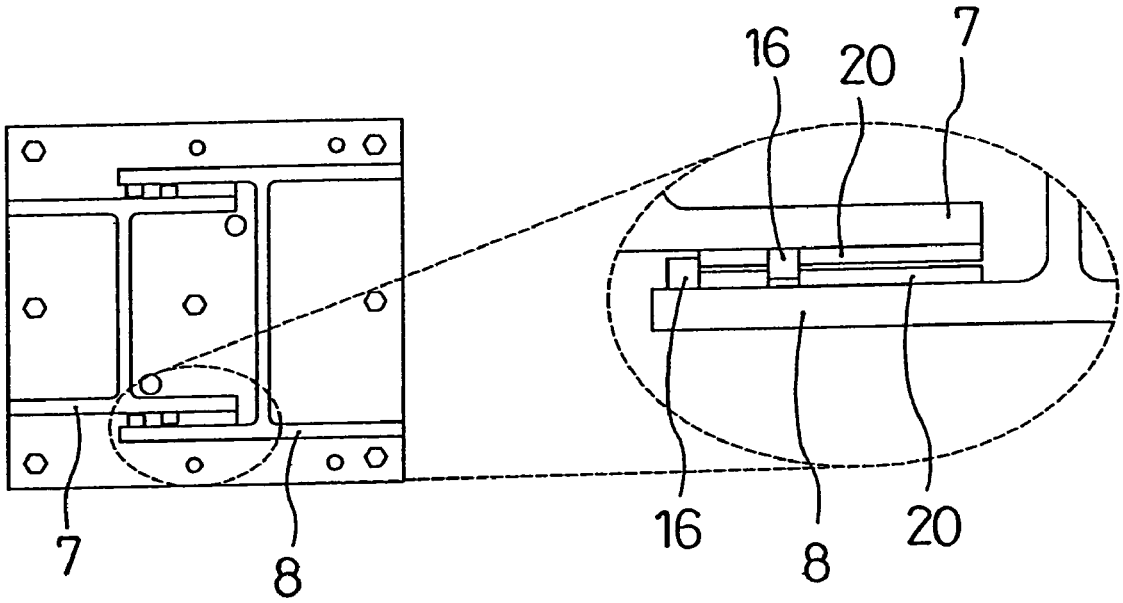
FIG. 15 is a plan view of the testing apparatus.
Figure 16:
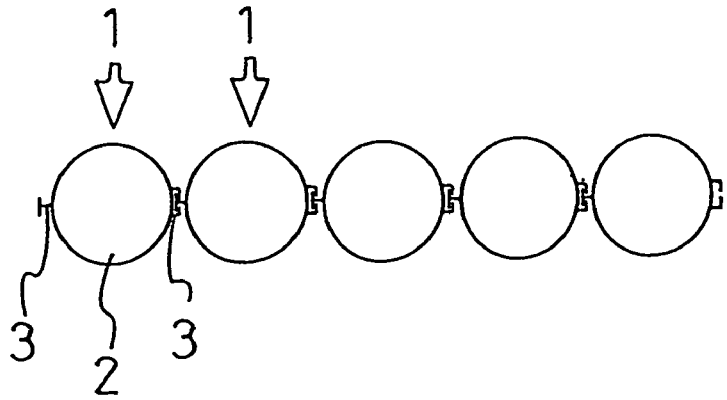
FIG. 16 PRIOR ART
FIG. 16 is a plan view showing a first example of a conventional steel-pipe sheet pile.
Figure 17:
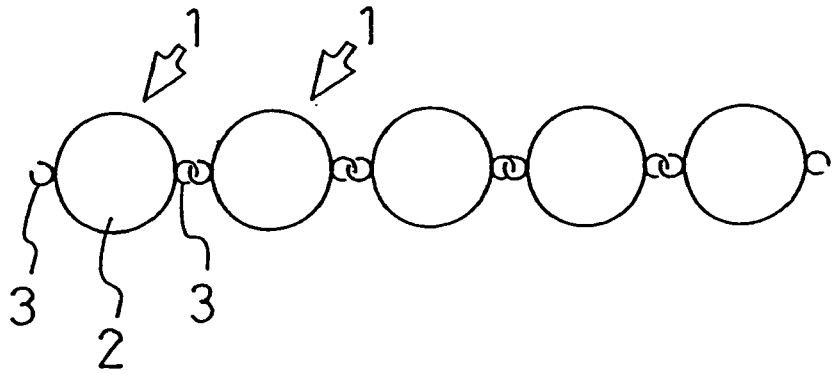
FIG. 17 PRIOR ART
FIG. 17 is a plan view showing a second example of a conventional steel-pipe sheet pile.
Figure 18:
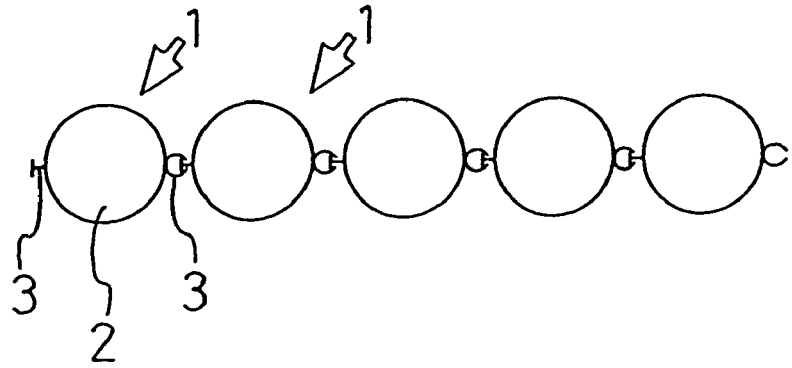
FIG. 18 PRIOR ART
FIG. 18 is a plan view showing a third example of a conventional steel-pipe sheet pile.
Figure 19:
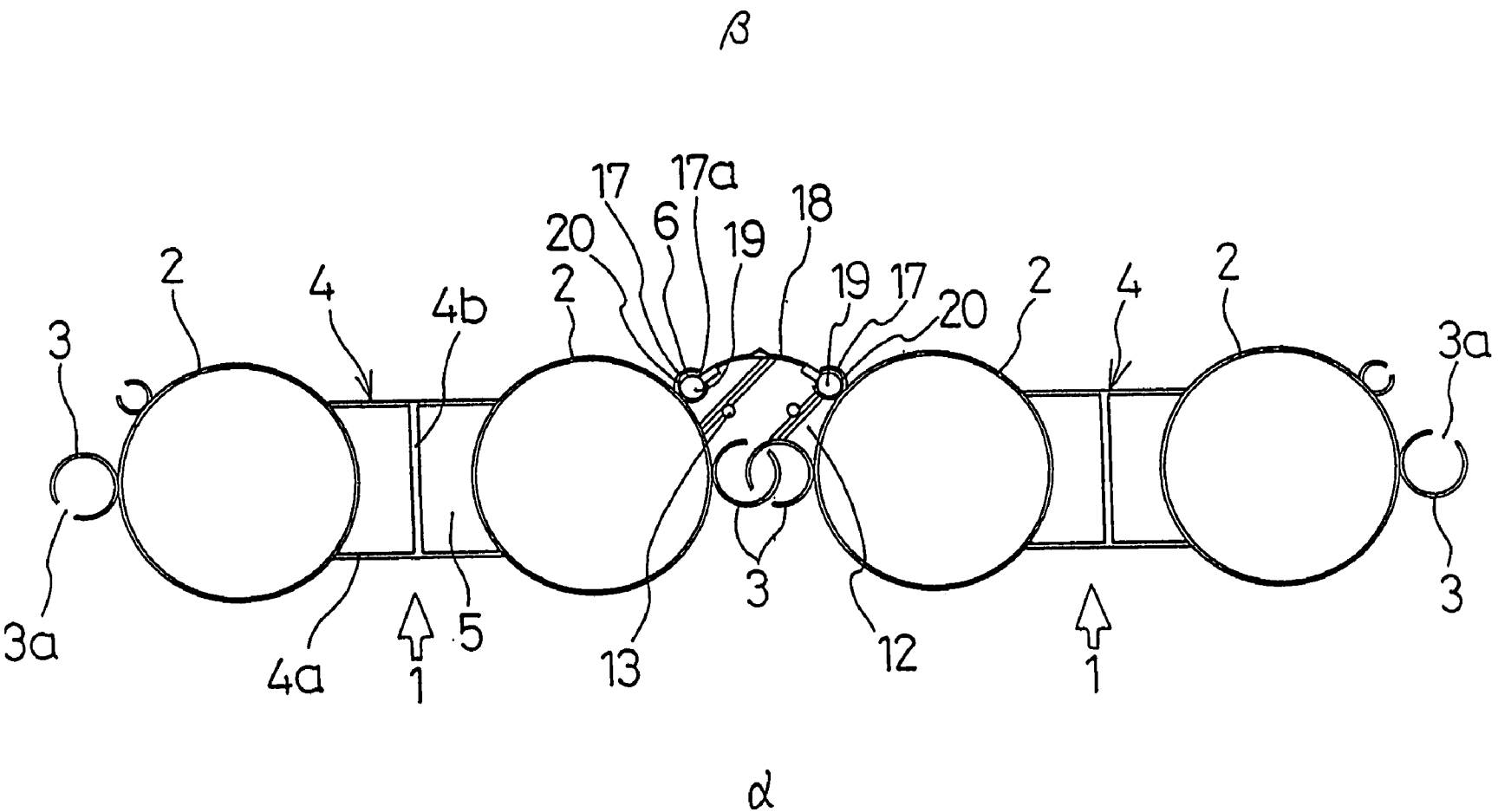
FIG. 19 PRIOR ART
FIG. 19 is a plan view of a conventional coupling structure of steel-pipe sheet piles.

There shall be adopted a water permeability test system and a test sample shown in FIG. 14. The swelling waterproof materials 20 (water swelling sheets) are adhered to flanges at locations (contacting positions of the H-shaped steel-beams having the different sizes) shown in FIG. 15. The adhered thicknesses of the swelling waterproof materials 20 are considered to affect the swelling amounts and the swelling pressures, to thereby resultingly affect the water-shielding ability of the male joint 7 and female joint 8 (H—H shape steel joint). Thus, there shall be considered the water-shielding ability of the H—H shape steel joint adhered with the swelling waterproof materials 20 at different thicknesses (1, 2 and 3 mm). Here, the inflow water pressure is raised stepwise to 0.02, 0.05, 0.1, 0.2, 0.3, 0.4 and 0.5 MPa, for the H—H shape steel joints having the different adhered thicknesses, respectively. The holding time of each pressure is 6 hours, and the water leakage amount is measured every 30 minutes. The test cases are shown in the following Table 1.

TABLE 1

| Test Pattern | | | |
|---|---|---|---|
| Test ID | Adhered Thickness (mm) | Presence/Absence of filled mortar | Load Water Pressure (MPa) |
| Case-1 | 1 | absent | 0.02, 0.05, 0.1, 0.2, 0.3, 0.4, 0.5 |
| Case-2 | 2 | absent | 0.02, 0.05, 0.1, 0.2, 0.3, 0.4, 0.5 |
| Case-3 | 3 | absent | 0.02, 0.05, 0.1, 0.2, 0.3, 0.4, 0.5 |

Note: When a sufficient water permeability coefficient is not obtained by adhering a water swelling sheet, there is also considered an effect of mortar filling.

Each test sample is evaluated by a converted water permeability coefficient $k_e$, in which the steel-pipe sheet pile wall is calculated as a uniform water permeating layer having a thickness of 50 cm by the following equation-1, in conformity to the Darcy's Law and based on the inflow/outflow water amounts per 30 minutes obtained from the respective water permeability tests.

$$Q=v\cdot A=k_e\cdot i\cdot B\cdot L=k_e\cdot B\cdot L\cdot \Delta h/T \quad \text{(equation 1)}$$

wherein

Q: observed water leakage amount ($cm^3$);

v: flow rate (cm/s);

A: sectional area (A=B×L) ($cm^2$);

B: width of a joint portion, or a total width (cm) of steel-pipe sheet piles and joint portion;

L: height (cm) of a test sample;

$k_e$: converted water permeability coefficient (cm/s);

i: hydraulic gradient (i=H/T);

H: water head difference (cm); and

T: converted water permeating layer thickness (cm) (T=50).

It is typical to use a converted water permeability coefficient in evaluating a water-shielding ability of a joint portion, so that the converted water permeability coefficient is to be also calculated in this test.

The testing procedure is as follows.

(1) The swelling waterproof materials 20 (water swelling sheets) are adhered to the male joint 7 and female joint 8 (H—H shape steel joint) at predetermined adhered thicknesses within a clearance between the joints.

(2) Each test sample is hermetically sealed by an upper lid and rubber packing (fixed at six locations).

(3) Inflow side, inside of H—H shape steel and outflow side are saturated by distilled water (removal of interior air by an air valve).

(4) Leave for 24 hours.

(5) Each predetermined water pressure is held, and inflow and outflow water amounts are measured every 30 minutes. Each pressure is held for 6 hours.

(6) The pressure is increased stepwise, and the operation (5) is repeated.

Expected Result:

Results to be expected by conducting this test are as follows.

(1) The converted water permeability coefficient (water-shielding ability) of the connecting portion between the male joint 7 and female joint 8 (H—H shape steel joint) is obtained to thereby clarify the applicability of the sheet piles as a revetment for a waste landfill.

(2) It is clarified that the male joint 7 and female joint 8 (H—H shape steel joint) exhibit a water-shielding ability better than the conventional type joint.

(3) In designing the male joint 7 and female joint 8 (H—H shape steel joint), there can be determined an optimum adhering thickness of a water swelling sheet capable of exhibiting a sufficient water-shielding ability.

(4) The jointed-steel-pipe sheet pile including the male joint 7 and female joint 8 (H—H shape steel joint) is proposed as a component effective for reducing the environmental burden.

As shown in FIG. 5 through FIG. 10, it is further possible to projectingly provide a coupling member 10 of a T-shaped transverse cross-section from the center of the web 7*b* of male joint 7 toward the exterior, in addition to the above structure of the steel-pipe sheet pile 1. This coupling member 10 has a base portion 10*a* and a top portion 10*b* of the T shape, such that the lower end of the base portion 10*a* is coupled to the web 7*b*, and the top portion 10*b* is protruded parallelly to the web 7*b* and has a width shorter than that of the web 7*b*.

In turn, the web 8*b* of the female joint 8 is formed with a cut-out 11 to be inserted with an intermediate portion of the base portion 10*a* of the coupling member 10.

The fitting between each male joint 7 and the associated female joint 8 is established such that the flanges 7*a* of the male joint 7 are brought to be interposed between the flanges 8*a* of the female joint 8 so that the flanges 7*a*, 8*a* are overlapped with each other and the tip ends of the flanges 7*a* are brought closer to the flange 8*a* of the female joint 8, while the base portion 10*a* of the coupling member 10 is inserted through the cut-out 11 so that the top portion 10*b* enters the inside of the web 8*b* of the female joint 8.

This defines a tightly closed space enclosed by the flanges 7*a*, 8*a* and web 7*b*, and this tightly closed space is split into three spaces by the coupling member 10. These spaces include: a first space 12*a* which is inserted with the top portion 10*b* and is enclosed by the flanges 8*a* of the female joint 8 and the peripheral surface of the steel pipe 2; a second space 12*b* enclosed by one flange 7*a* of the male joint 7, the web 7*b*, the web 8*b* of the female joint 8, and the base portion 10*a* of the coupling member 10; and a third space 12*c* enclosed by the other flange 7*a*, the web 7*b*, the web 8*b* of the female joint 8, and the base portion 10*a* of the coupling member 10, similarly to the second space 12*b*.

These first through third spaces 12*a*, 12*b*, 12*c* are provided for water stopping, and it is possible to fill the filling material 9 such as concrete or mortar into the spaces 12*a*, 12*b*, 12*c* by using a tremie pipe.

In this way, the steel-pipe sheet piles 1 are coupled to each other by the fitting between the mated male joint 7 and female joint 8 in a manner that the coupling member 10 is further interposed in the tightly closed space defined at the joint portion to thereby attain the fitting which is not easily released, thereby allowing prevention of so-called pile opening, while the water infiltrating into the second space 12*b* of the tightly closed space from the overlapping portion of the flanges 7*a*, 8*a* at one side, is obliged to: pass along the base portion 10*a* of the coupling member 10 and the cut-out 11 and up to the top portion 10*b*; then flow into the first space 12*a*; subsequently and again pass along the base portion 10*a* of the coupling member 10 to enter the third space 12*c*; and thereafter reach the flanges 7*a*, 8*a* at the other side.

Thus, the flowing distance of the infiltrating water from the outside to the inside of the steel-pipe sheet pile 1 is prolonged by the roundabout through the first through third spaces 12*a*, 12*b*, 12*c* by virtue of the interposition of the coupling member 10, thereby improving the water stopping ability.

The water stopping effect is further enhanced by filling the filling material 9 into the first through third spaces 12*a*, 12*b*, 12*c*.

Although the provision of the cut-out 11 in the web 8*b* of the female joint 8 causes the opposing flanges 8*a* to tend to be opened into a flared shape, the embedment of the coupling member 10 in the filling material 9 increases the bonding force between the filling material 9 and joint steel materials to prevent the opposing flanges 8*a* from flaring out, thereby allowing prevention of deformation thereof.

Figure 11:
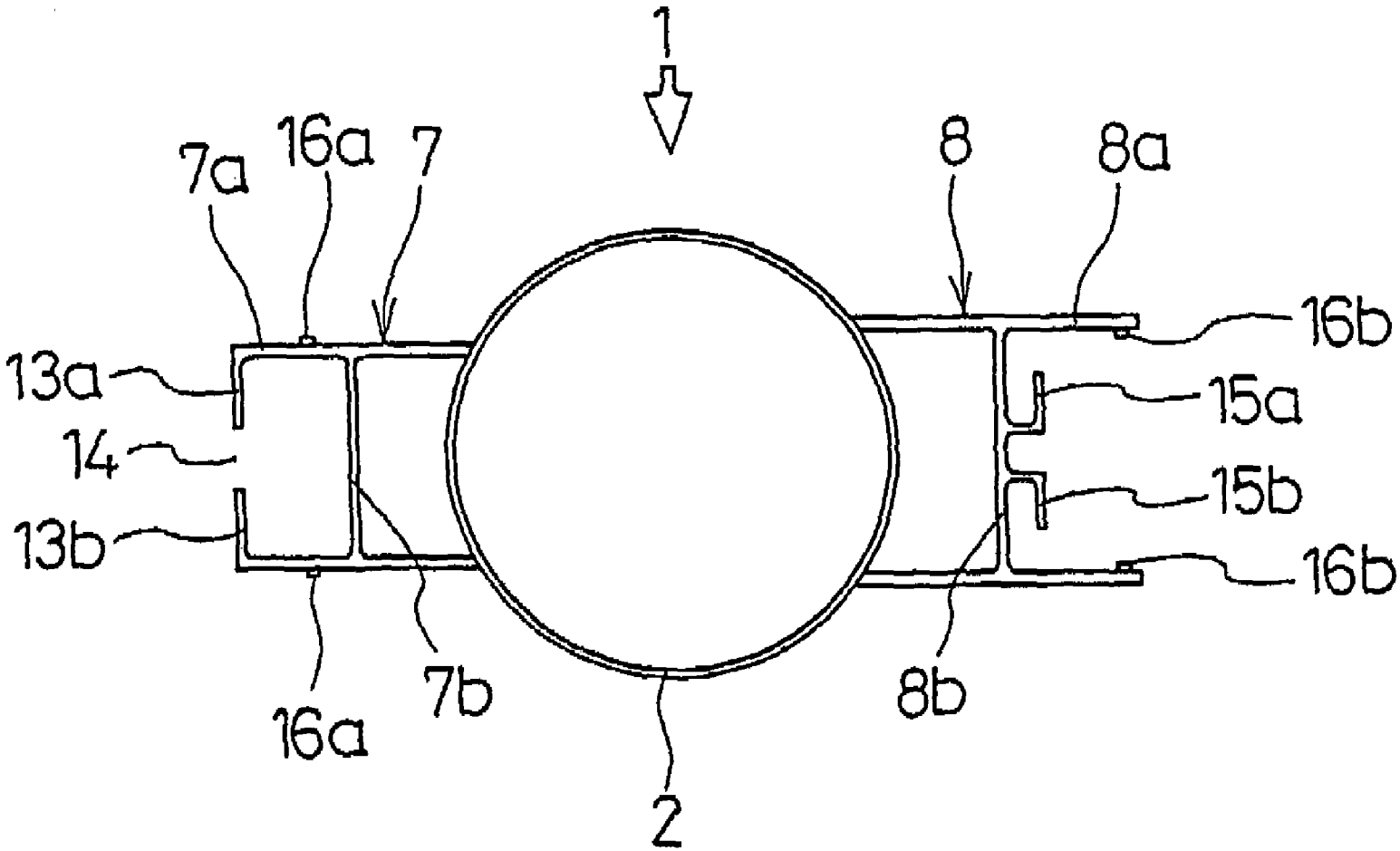
FIG. 11 is a plan view showing a third embodiment of one unit of steel-pipe sheet pile according to the present invention.
Figure 12:
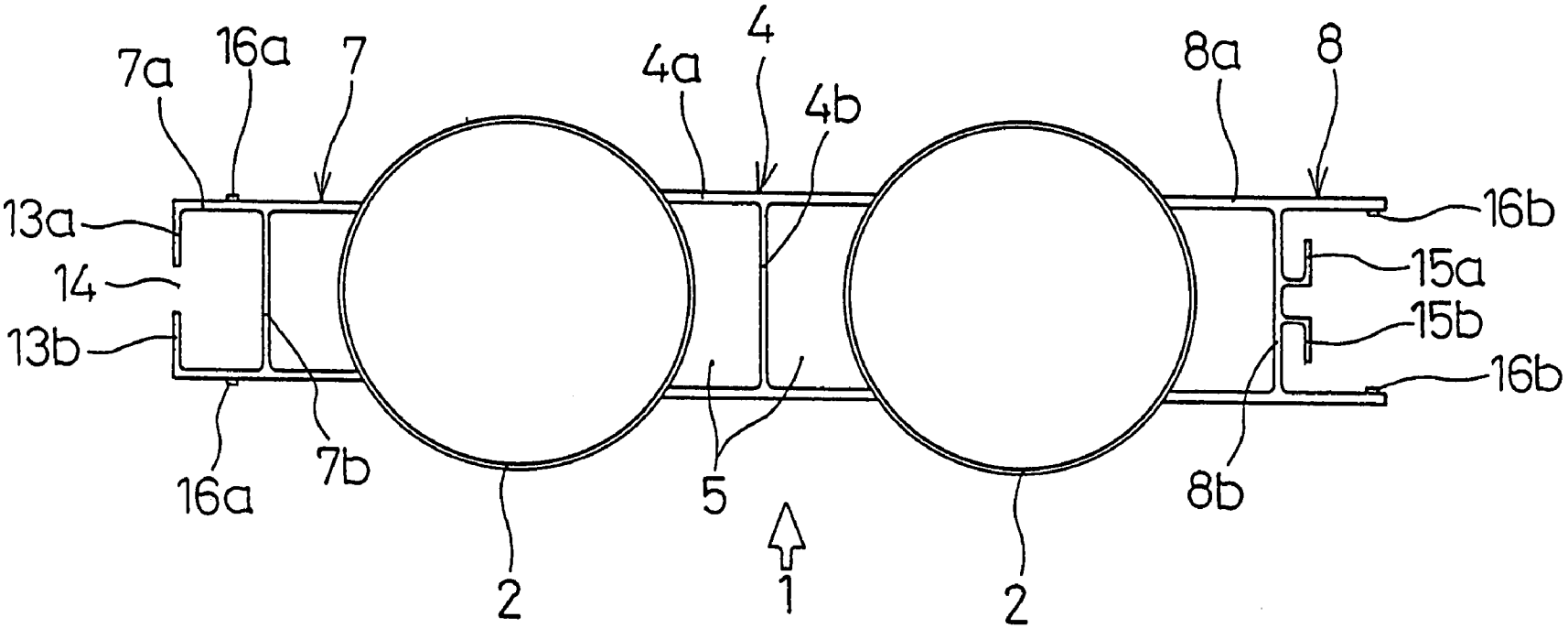
FIG. 12 is a plan view of a third embodiment of one unit of double-pipe type of steel-pipe sheet pile according to the present invention.
Figure 13:
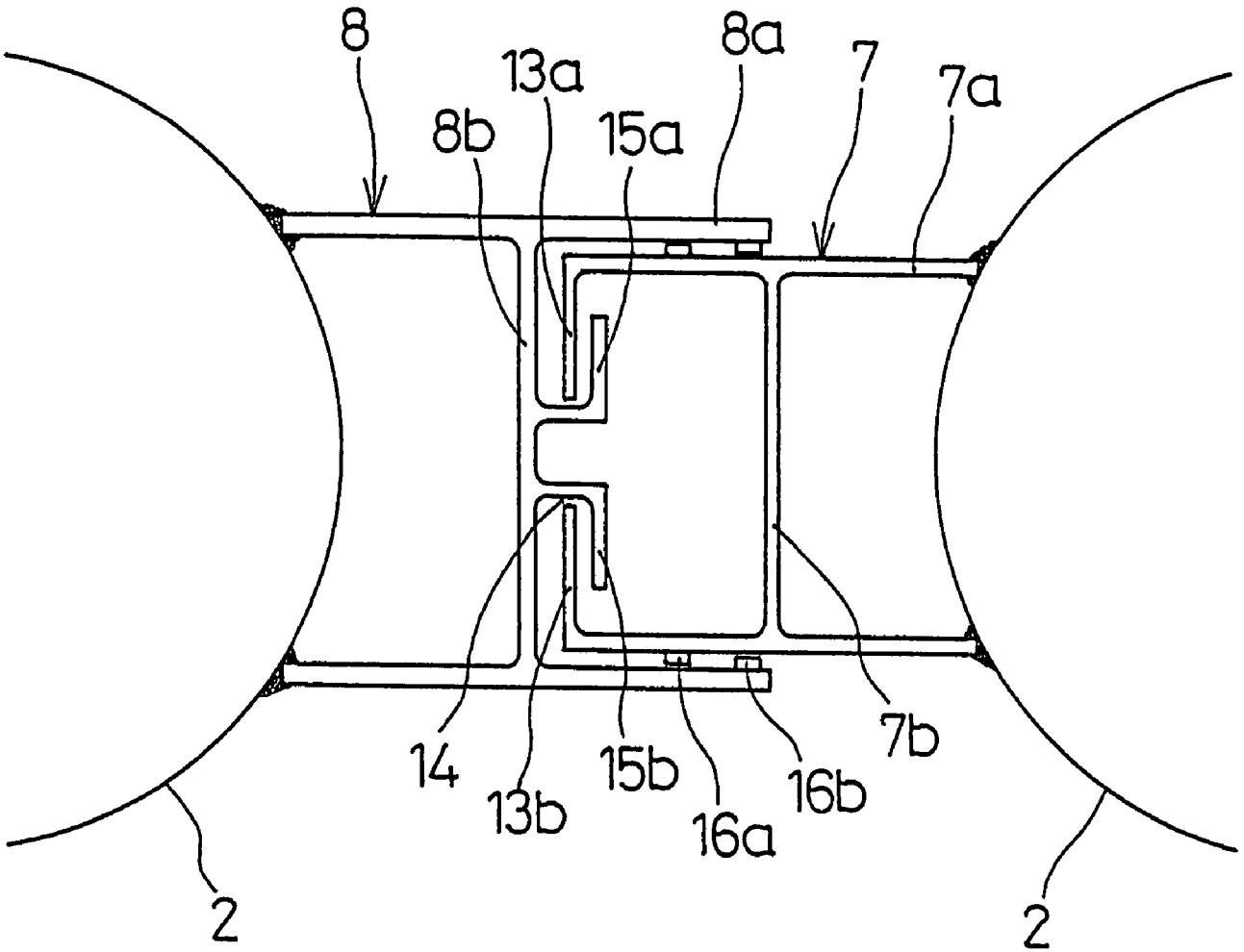
FIG. 13 is a plan view of essential parts of a third embodiment of a coupling structure of steel-pipe sheet piles according to the present invention.

FIGS. 11 through 13 show another embodiment in which projected segments 13*a*, 13*b* parallel to the web 7*b* are projectedly and opposingly provided from the tip ends of the flanges 7*a* of the male joint 7 in a manner to define a clearance 14 between tip ends of the projected segments 13*a*, 13*b*.

In turn, the female joint 8 is projectedly provided at its web 8*b* with protruded and then outwardly directed angle pieces 15*a*, 15*b* for fitting to the projected segments 13*a*, 13*b* such that the tip ends of the protruded angle pieces 15*a*, 15*b* are inserted inside the projected segments 13*a*, 13*b* through the clearance 14 between the projected segments 13*a*, 13*b* so that the tip end portions of the protruded angle pieces 15*a*, 15*b* are fitted to the projected segments 13*a*, 13*b*.

Further, ribs 16*a*, 16*b* are projectedly provided at the outside of the flanges 7*a* of the flange 7*a* and at the inside of the flanges 8*a* of the female joint 8, at such positions that the surfaces of these ribs do not come to directly oppose to each other.

Fitting the male joint 7 and female joint 8 to each other in this way overlaps the flanges 7*a*, 8*a* thereof with each other, such that the protruded angle pieces 15*a*, 15*b* are inserted through the clearance 14 into the space enclosed by the overlapping portions and the webs 7*b*, 8*b*, and the protruded angle pieces 15*a*, 15*b* are fitted to the projected segments 13*a*, 13*b*. In this state, the tip end portions of the protruded angle pieces 15*a*, 15*b*, the projected segments 13*a*, 13*b* and the web 8*b* are triply overlapped with one another.

Further, the ribs 16*a*, 16*b* are abutted onto each other at the short sides thereof while the long sides thereof abut on the opposing flanges 7*a*, 8*a* such that the ribs 16*a*, 16*b* are interposed between the overlapped flanges 7*a*, 8*a*. Thus, not only the water stopping between the flanges 7*a*, 8*a* is further enhanced, but also the long sides of the ribs 16*a*, 16*b* abut onto each other against a pulling force in a direction separating the steel pipes 2 from each other to thereby resist such a pulling force, thereby further enhancing the rigidity of the coupling.

Thus, even when water has infiltrated into the interior of the joints through the overlapping portion between the flanges 7*a*, 8*a* at one sides of the male joint 7 and female joint 8, the infiltrating water does not reach the flanges 7*a*, 8*a* at the other sides unless the infiltrating water travels from the flanges 7*a*, 8*a* through multiple curves at the overlapping portions between the projected segments 13*a*, 13*b* and the protruded angle pieces 15*a*, 15*b*, thereby prolonging the distance for water flow as compared with the conventional, to thereby improve the water stopping operation.

Moreover, the fitting between the projected segments 13*a*, 13*b* and protruded angle pieces 15*a*, 15*b* improves the rigidity of coupling of the male joint 7 to the female joint 8.

Figure 10:
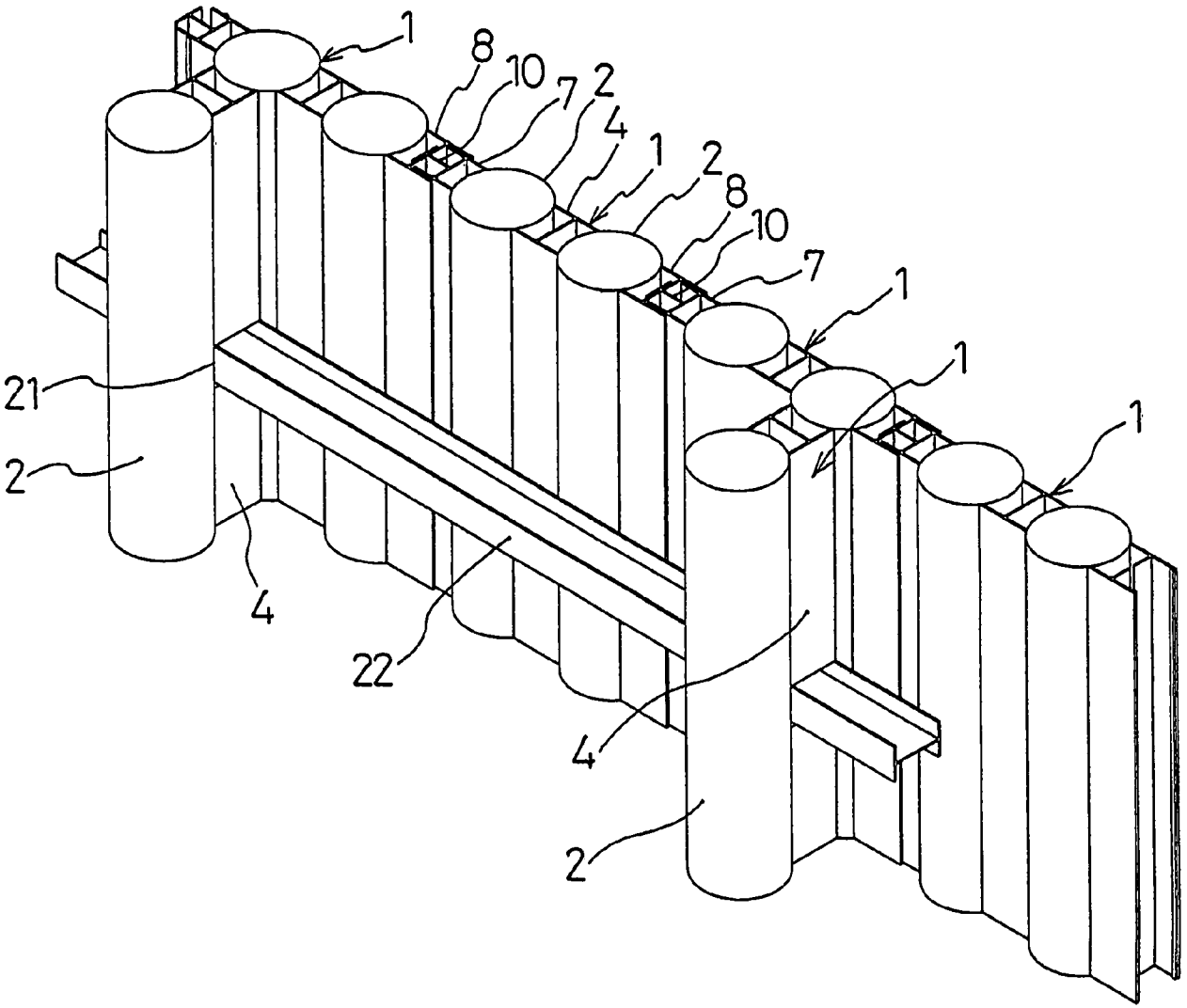
FIG. 10 is a perspective view of the second embodiment of the coupling structures of steel-pipe sheet pile according to the present invention.

In case of mutually coupling steel-pipe sheet piles 1 as timbering unit members in a horizontal row as shown in FIG. 10, selected one steel pipe 2 of an applicable steel-pipe sheet pile 1 is coupled with an additional steel pipe 2 in a manner juxtaposed to the selected steel pipe 2 via H-shaped steel-beam 4 as a tying material (plate), thereby providing a double-pipe type of steel-pipe sheet pile 1 orthogonal to the horizontal row.

As a result, the H-shaped steel-beam 4 as the tying material and the steel pipe 2 at the end thereof are disposed behind an earth retaining wall, in each additional orthogonal steel-pipe sheet pile 1.

Moreover, the H-shaped steel-beam 4 as the tying material of each orthogonal steel-pipe sheet pile 1 is formed with a horizontal through-hole 21, and there is provided an H-shaped steel-beam 22 as a horizontal member made of steel material penetrating through the horizontal through-holes 21 behind the earth retaining wall. Such a horizontal through-hole 21 can be readily defined by excluding provision of H-shaped steel-beams 4 as tying materials at the location for the horizontal through-hole 21, in a manner to resultingly ensure a space for the horizontal through-hole 21 between the upper and lower H-shaped steel-beams 4.

Further, the H-shaped steel-beam 22 as the horizontal member is provided as a so-called waling, and the strong axis direction of the H-shaped steel-beam is oriented in the horizontal direction such that the pertinent flange thereof is joined to the steel pipes 2 constituting the earth retaining wall. In this way, the H-shaped steel-beam 22 as the horizontal member is supported by the H-shaped steel-beams 4 as the tying materials, and can be thus arranged stably without using a bracket or the like for supporting.

EFFECT OF THE INVENTION

The steel-pipe sheet pile and the coupling structure of steel-pipe sheet piles of the present invention as described above are capable of improving both of the rigid ability and water-stopping ability at a gap between joints not only in steel-pipe sheet piles each comprising a single steel pipe provided at opposite peripheral sides thereof with joints, respectively, but also in a double-pipe type of steel-pipe sheet pile. Further, the coupling member is interposed in the gap between joints to thereby prolong the length of the path through which the infiltrating water is to flow, thereby enabling improvement of the water-stopping ability.

What is claimed is:

1. A steel-pipe sheet pile including a steel pipe and joints for coupling the steel pipe to another steel pipe in multiple steel pipes arranged in a building direction of a steel-pipe sheet pile wall, wherein said joints include a male joint and a female joint each made of an H-shaped steel-beam coupled at flange edges to a peripheral surface of said steel pipe, and wherein said male joint is slightly small-sized relative to said female joint so that said male joint can be fitted in a space defined by flange inside surfaces and web surface of a female joint of a neighboring steel-pipe sheet pile; and said steel-pipe sheet pile is a joined-steel-pipe sheet pile in which multiple steel pipes are integrally coupled to one another via tying members of H-shaped transverse cross-sections, respectively, such that each tying member has flange edges coupled to peripheral surfaces of the associated steel pipes to be plurally arranged in said building direction of a steel-pipe sheet pile wall.

2. The steel-pipe sheet pile of claim 1, wherein the inside surfaces of said flanges of said female joint and the outside surfaces of said flanges of said male joint are provided with projections, respectively.

3. The steel-pipe sheet pile of claim 1, wherein said male joint is provided with projected segments projected from flange tip ends of said male joint; respectively, opposingly to each other and parallelly to said web of said male joint, in a manner to define a clearance between tip ends of said projected segments, and wherein said female joint is provided with outwardly protruded angle pieces projected from said web of said female joint so as to fit to the projected segments.

4. A steel-pipe sheet pile including a steel pipe and joints for coupling the steel pipe to another steel pipe in multiple steel pipes arranged in a building direction of a steel-pipe sheet pile wall, wherein said joints include a male joint and a female joint each made of an H-shaped steel-beam coupled at flange edges to a peripheral surface of said steel pipe, and wherein said male joint is slightly small-sized relative to said female joint so that said male joint can be fitted in a space defined by flange inside surfaces and web surface of a female joint of a neighboring steel-pipe sheet pile; and said steel-pipe sheet pile further comprises:

a coupling member having a T-shaped cross-section and outwardly protruded from the web of said male joint; and a cut-out defined at the web of said female joint so that said cut-out is inserted with a T-shaped coupling member of a neighboring steel-pipe sheet pile.

5. A coupling structure of steel-pipe sheet piles each including a steel pipe, a male joint and a female joint, wherein said male joint and said female joint are made of H-shaped steel-beams having flange edges coupled to a peripheral surface of said steel pipe, and wherein said male joint of one steel-pipe sheet pile is fitted in a space defined by flange inside surfaces and web surface of a female joint of a neighboring steel-pipe sheet pile in a manner to sequentially couple the steel-pipe sheet piles to one another to thereby constitute a steel-pipe sheet pile wall; and said steel-pipe sheet pile is a jointed-steel-pipe sheet pile in which multiple steel pipes are integrally coupled to one another via tying members of H-shaped transverse cross-sections, respectively, such that each tying member has flange edges coupled to peripheral surfaces of the associated steel pipes to be plurally arranged in a building direction of a steel-pipe sheet pile wall.

6. The coupling structure of steel-pipe sheet piles of claim 5, further comprising swelling waterproof materials provided at inside surfaces of flanges of said female joint and outside surfaces of flanges of said male joint, respectively, of each steel-pipe sheet pile.

7. The coupling structure of steel-pipe sheet piles of claim 5, further comprising projections and swelling waterproof materials provided at inside surfaces of flanges of said female joint and outside surfaces of flanges of said male joint, respectively, of each steel-pipe sheet pile.

8. A coupling structure of steel-pipe sheet piles each including a steel pipe, a male joint and a female joint, wherein said male joint and said female joint are made of H-shaped steel-beams having flange edges coupled to a peripheral surface of said steel pipe, and wherein said male joint of one steel-pipe sheet pipe is fitted in a space defined by flange inside surfaces and web surface of a female joint of a neighboring steel-pipe sheet pile in a manner to sequentially couple the steel-pipe sheet piles to one another to thereby constitute a steel-pipe sheet pile wall; and each of said steel-pipe sheet piles further comprises:

a coupling member having a T-shaped cross-section and outwardly protruded from the web of said male joint; and a cut-out defined at the web of said female joint so that said cut-out is inserted with a T-shaped coupling member of a neighboring steel-pipe sheet pile; and wherein the fitting between said male joint and said female joint defines water stopping spaces comprising: a first space enclosed by the web and flanges of said female joint and a peripheral surface of the steel pipe; and second and third spaces enclosed by the web of said female joint, flanges and webs of said male joint of a neighboring sheet pile and split by the T-shaped coupling member of the neighboring sheet pile.

* * * * *